United States Patent [19]

Rudoy

[11] Patent Number: 4,973,255

[45] Date of Patent: Nov. 27, 1990

[54] LOCKING/EJECTING MECHANISM FOR CONNECTOR SYSTEM

[75] Inventor: Edward Rudoy, Woodland Hills, Calif.

[73] Assignee: ITT Corporation, New York, N.Y.

[21] Appl. No.: 405,781

[22] Filed: Sep. 11, 1989

[51] Int. Cl.[5] ..... H01R 13/62

[52] U.S. Cl. ..... 439/157; 439/160

[58] Field of Search ..... 439/152–160, 439/64, 55, 65; 361/395, 399, 412, 415; 403/16, 321, 325

[56] References Cited

U.S. PATENT DOCUMENTS

| | | | |
|---|---|---|---|
| 2,987,693 | 6/1961 | Wamsley | 339/91 |
| 4,168,877 | 9/1979 | Little et al. | 339/103 |
| 4,178,051 | 12/1979 | Kocher et al. | 339/45 |
| 4,214,800 | 7/1980 | Hollyday et al. | 339/45 |
| 4,241,966 | 12/1980 | Gomez | 339/45 |
| 4,341,428 | 7/1982 | Hatch et al. | 339/14 |
| 4,410,222 | 10/1983 | Enomoto et al. | 339/17 |
| 4,447,101 | 5/1984 | Gigliotti | 339/45 |
| 4,469,388 | 9/1984 | Narozny | 339/45 |
| 4,480,885 | 11/1984 | Coppelman | 439/159 |
| 4,537,454 | 8/1985 | Douty et al. | 439/157 |
| 4,579,408 | 4/1986 | Sasaki | 339/45 |
| 4,582,378 | 4/1986 | Fruchard | 439/157 |

FOREIGN PATENT DOCUMENTS

| | | |
|---|---|---|
| 2115239 | 2/1982 | United Kingdom . |
| 2082401 | 3/1982 | United Kingdom . |

*Primary Examiner*—David L. Pirlot

[57] ABSTRACT

A mechanism is described for use with a pair of matable connectors, for locking them together when they have been mated and for later ejecting one from the other, which has the same narrow width as the connectors alone. The mechanism includes a pair of locking/ejecting devices or members (42, 44) pivotally mounted to opposite ends of a first connector (12). The second connector (14) has a shroud (61) with openings (62) near its opposite ends that receive inner parts (72) of the locking members. The inner part of each locking member has a latch (94) that is received in an undercut slot in the shroud, that extends from a shroud opening in the locked position. Each locking member also has an eject part (106) that presses against the base of the second connector as the locking member is pivoted to its eject position, to eject the first connector from the second.

5 Claims, 3 Drawing Sheets

LOCKING/EJECTING MECHANISM FOR CONNECTOR SYSTEM

BACKGROUND OF THE INVENTION

Many connector systems includes a first connector whose mating end or region enters a shroud of a second connector as the connectors are mated. It is often desirable to provide a mechanism that can be easily operated to lock the connectors together, and to eject the first connector from the second in a manner to easily overcome the resistance to initial unmating. Existing mechanisms of this type are located outside the connectors, as a totally "add-on" feature that involves minimal alteration of the existing connector. As a result, the locking mechanism adds substantially to the width and length of the system, which prevents its use in applications where there is limited space, especially in the width of the connector system. Also, existing locking/ejecting mechanisms systems may engage locations on a pair or connectors that are spaced far from the matable inner regions of the connectors. As a result, the mechanism operates at locations where there is an accumulation of tolerances and the mechanism must be loose or the tolerances of the connectors must be held close. A mechanism useful to lock a pair of connectors together or eject one from the other, which was of relatively simple construction, which avoided increasing the width of the system, and which did not require closer tolerances of the connectors, would be of considerable value.

SUMMARY OF THE INVENTION

In accordance with one embodiment of the present invention, a connector system is provided, which includes a pair of matable connectors and a mechanism for locking them together in a mated position and for ejecting one from the other, which is of simple and compact construction. A pair of locking/ejecting devices are pivotally mounted at opposite ends of a first connector whose matable inner region enters a shroud at the inner region of a second connector during mating. Each locking device has an inner part with a latch that is received in an undercut slot of the second connector. The shroud of the second connector has openings communicating with the undercut slots, with the inner parts of the locking devices passing into the openings as the connectors are mated. The inner part of each locking device has a thickness about the same as that of the shroud, so the inner part covers the shroud opening but does not substantially increase the overall width of the connector system.

Each locking/ejecting device includes an eject part, that can be constructed to press against the base of the second connector when the locking device is pivoted to an eject position. Each locking device at each end of the first connector, can include two inner parts lying on opposite sides of the first connector, and a bridging part that connects them.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
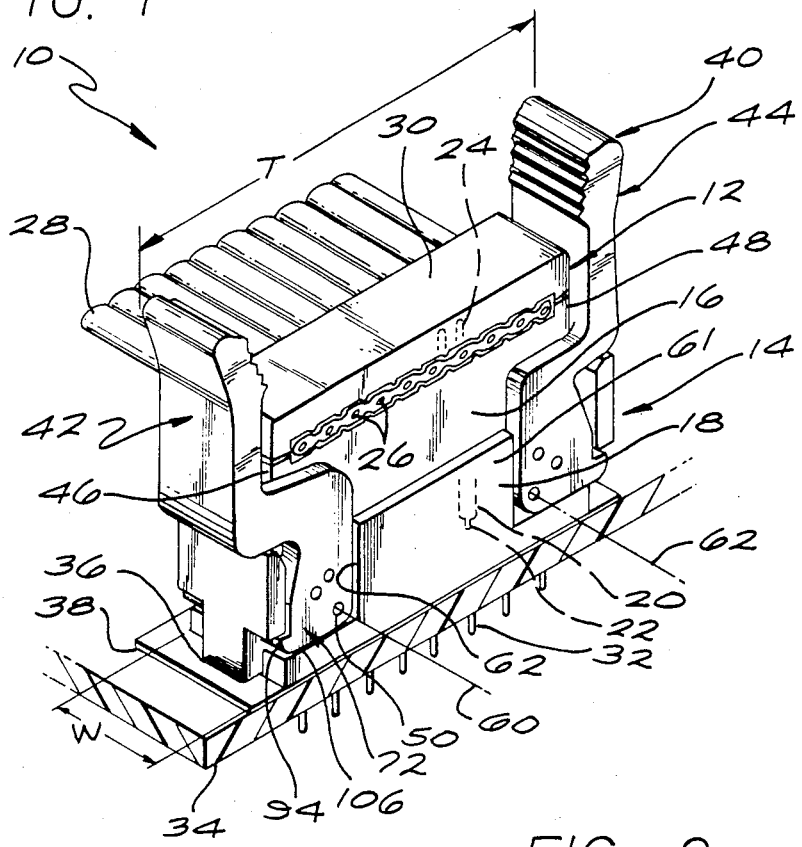
FIG. 1 is an isometric view of a connector system constructed in accordance with the present invention, shown mounted on a circuit board, and with the locking/ejecting mechanism in a locked position.

FIG. 1 illustrates a connector system 10 which includes first and second connectors 12, 14 that have matable inner regions 16, 18. When the inner regions are brought together, contacts 20, 22 on the two connectors are mated. The contacts of the first connector have insulation-displacing ends 24 that engage conductors 26 of a ribbon cable 28 at the outer end 30 of the first connector. The contacts of the second connector have ends 32 that extend through plated-through holes (not shown) in a circuit board 34 to connect to conductive traces (not shown) on the underside of the board. The outer end 36 of the second connector is connected to a ground plane 38 on the circuit board.

Figure 2:
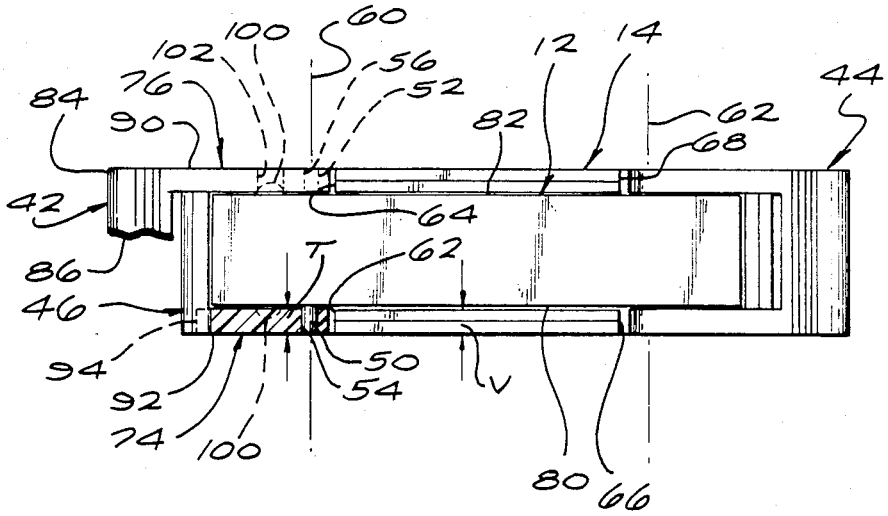
FIG. 2 is a partially sectional plan view of the connector system of FIG. 1.

A locking/ejecting mechanism 40 is provided, which helps to lock the mated connectors together, and which is especially useful in ejecting the first connector from the second when they are to be unmated. The mechanism includes a pair of locking/ejecting devices or members 42, 44 mounted at the opposite ends 46, 48 of the first connector 12. A pair of trunnions or shafts 50, 52 (FIG. 2) are received in holes 54, 56 in each locking member to pivotally mount the locking member about a pivot axis 60 or 62.

Figure 3:
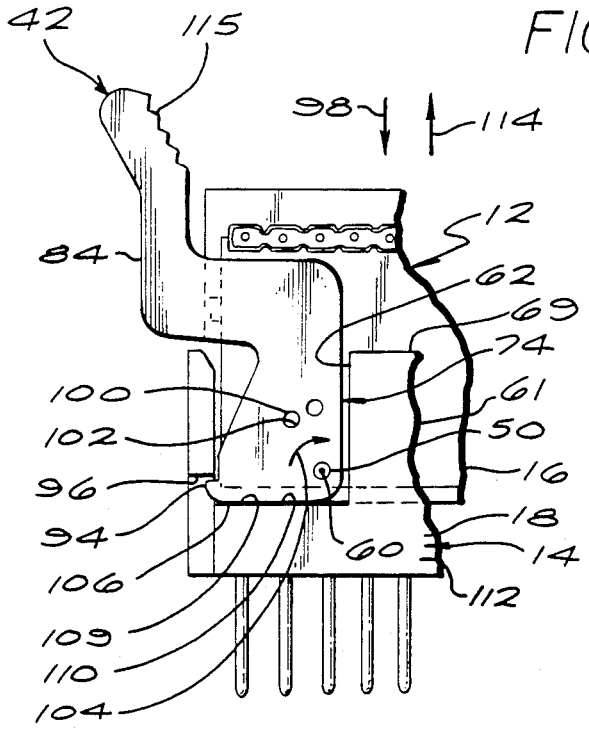
FIG. 3 is a partial side elevation view of the connector system of FIG. 1, with the mechanism in a locked position.

The inner region 18 (FIG. 3) of the second connector 14 includes a shroud 61 that largely surrounds the mating regions of the two connectors to protect the contacts. It is often only necessary to prevent the penetration of large mechanical objects into the mating region, and not to prevent the entrance of fluid or very small particles. Applicant forms openings 62, 64, 66, 68 (FIG. 2) in the shroud, extending from the outer edge 69 of the shroud to the base 112 of the second connector. The openings receive part of the locking members 42, 44, to minimize the width W of the system when the locking/ejecting mechanism is included therein.

Each locking device or member such as 42 includes a pair of inner parts 74, 76 lying in the openings 62, 64 at the opposite sides 80, 82 of the first connector. Each locking member also includes a bridging part 84 with a middle 86 and opposite ends 90, 92, and that lies largely beyond an end 46 of the first connector. The inner parts such as 74 (FIG. 3) each has a latch 94 that lies in an undercut slot 96 that receives the latch 94 in the locked position of FIG. 3. The slot 96 is "undercut" in that it is largely hidden when the system is seen in a plan view (FIG. 2) along the mating direction 98.

Each inner part such as 74 of a locking member has a hole 102 that receives a projection or detent in the form of a dimple 100, to resist pivoting of the locking member. Disengagement of the connectors 12, 14 can occur only if the locking member 42 is pivoted in the direction of arrow 104. Such pivoting is resisted by the fact that the dimple 100 lies in the hole 102. To pivot the locking member 74, it is necessary to separate the opposite first parts 74, 76 so they ride out of the dimples 100, which requires deflecting them away from each other out of the dimples. The locking member 42 has sufficient resilience to oppose but allow such deflection.

In most situations, it requires substantial force to eject the first connector from the second so as to unmate them. Such unmating is accomplished by pivoting the locking member 42 in the direction of arrow 104. As the member pivots in that direction, an eject surface or portion 106 of the locking member, which is spaced from the pivot axis 60, bears against an eject-engaging surface 109 at the outer surface 110 of the base 112 of the second connector to push the first connector 12 outwardly in the direction of arrow 114. The bridging portion 84 of the locking member includes a handle 115 that can be pivoted in the direction 104 to pivot both inner parts 74, 76 of the locking member to lift one end of the first connector 12. Proper ejection requires pivoting both locking members 42, 44 lying at the opposite ends of the first connector.

The inner parts such as 74 that lie in the shroud opening 62, each have a thickness T (FIG. 2) about the same as the thickness V of a side of the shroud, that is, the thickness T is generally no more than about 50% greater than V. This results in the locking mechanism not increasing the width W of the connector system. The presence of the locking member does result in the length L of the system being somewhat greater, but the greater length exists only at the outer region of first connector, which lies far from the circuit board, and the increase in length is relatively small when the locking members are in their closed positions. The inner parts 74 of the locking member cover most of the opening 62, especially at the inner or mating region 16, 18, to protect the mated contacts.

Figure 4:
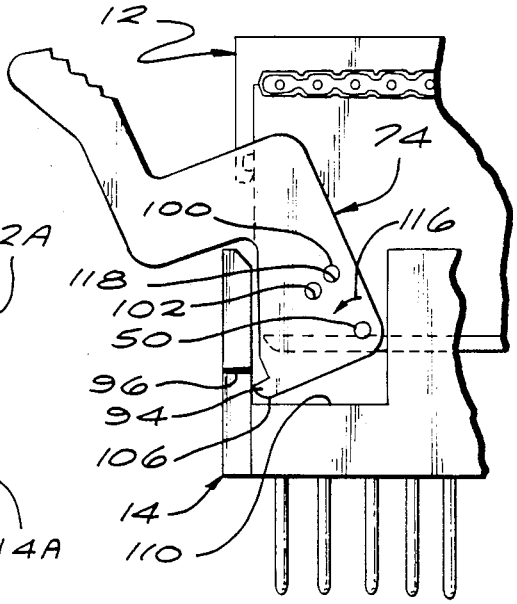
FIG. 4 is a view similar to that of FIG. 3, but with the mechanism in an ejected position.
Figure 5:
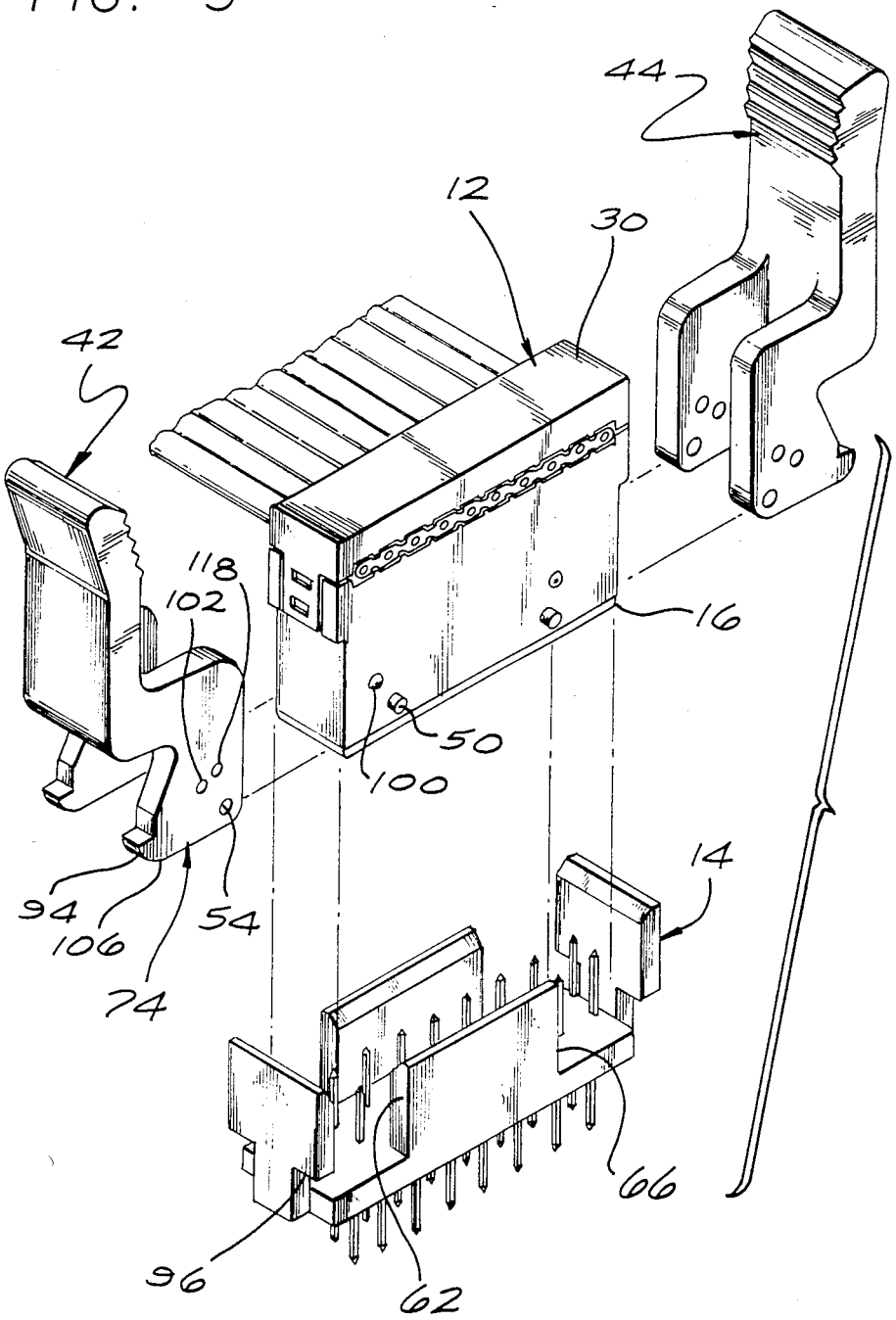
FIG. 5 is an isometric exploded view of the system of FIG. 1.

FIG. 4 shows how the first connector 12 is mated to the second one 14. The locking member has been pivoted in the eject direction 116 until the dimple 100 has entered another recess or hole 118 in the locking member inner part 74. As the first connector is pushed down in the mating direction 98, the eject part 106 encounters the base outer surface 110. Further downward movement of the connector causes the inner part 74 to pivot to bring the latch 94 into the undercut slot 96. Thus, the locking member automatically pivots to the locked position as the connectors are mated.

The locking members 42, 44 are easily installed, by separating the inner parts 74, 76 until the shafts 50, 52 snap into the holes 54, 56. The great simplicity of the mechanism reduces cost and increases reliability.

Figure 6:
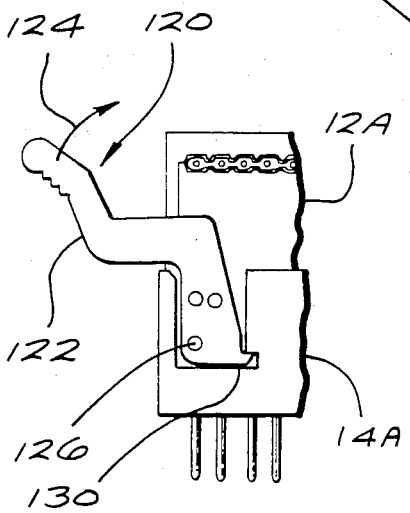
FIG. 6 is a partial side elevation view of a connector system constructed in accordance with another embodiment of the invention.

FIG. 6 illustrates another locking mechanism 120, wherein each locking member such as 122 pivots in the direction of arrow 124 about an axis 126 to cause an eject portion to eject a first connector 12A from a second one 14A.

Thus the invention provides a connector system with a locking/ejecting mechanism that is of simple and reliable construction, and which avoids increasing the width of the connector system. The locking mechanism includes a pair of locking members pivotally connected to opposite ends of a first connector whose inner region can enter a shroud in a second member to mate the connectors. The shroud has an opening therein extending from its outer edge to near its base, which receives an inner part of each locking member. The inner part carries a latch that is received in an undercut clot that communicates with the opening in the shroud. As the connectors are mated, the locking member is automatically pivoted to move the latch into the undercut slot to lock the connectors together. Dimples on the first connector engage recesses or holes in the inner parts, to resist pivoting of the locking member. The inner parts of the locking member lie on opposite sides of the first connector, so disengagement of the dimples with the recesses require resilient spreading apart of inner parts, which is resiliently resisted. Pivoting of the locking members towards an ejecting position causes eject surfaces or portions on the inner part to press against the second member, preferably at the base thereof, to controllably separate the connectors to control their unmating. The first parts of the locking members can be plate-like and are about as thick as the shroud, so they do not substantially increase the width of the connector system.

Although particular embodiments of the invention have been described and illustrated herein, it is recognized that modifications and variations may readily occur to those skilled in the art and consequently it is intended to cover such modifications and equivalents.

What is claimed is:

1. In a connector system which includes first and second connectors that each has opposite ends, opposite sides, a matable inner region, and an opposite outer region, and wherein said connectors have a plurality of matable contacts at said inner regions, the second connector having a shroud that largely surrounds the inner regions of the connectors as the connectors are mated and unmated, the improvement of a mechanism for alternately locking together and forceably separating said connectors comprising:

a pair of locking devices pivotally mounted at locked and unlocked positions, each device having an inner part, a pivot axis at said inner part, and a latch at said inner part, and each device having an eject portion, said device inner parts projecting from at least one side of said first connector;

said second connector has an undercut slot located to receive the latch part of a corresponding locking device in the locked position thereof, said second connector having an eject-engaging surface positioned to be engaged by said eject part when the locking devices are pivoted to disengage the connectors;

said shroud having an opening across its entire thickness substantially at each end of said second connector which receives the inner part of one of said devices as said devices approach each other and in both said locked and unlocked positions, each of said undercut slots communicating with one of said openings;

the inner part of each device having a thickness about the same as said shroud, so the inner part lies in the shroud opening but does not substantially project sidewardly from the shroud.

2. The improvement described in claim 1 wherein:

said second connector has a base with an outer surface, with said contacts of said second connector projecting from said base outer surface, said shroud extending outwardly from said base outer surface, said base outer surface forming said eject-engaging surface to be engaged by said eject part of a locking rejecting device, whereby to minimize the accumulation of tolerances.

3. The improvement described in claim 1 wherein:

said second connector and said shroud thereof has opposite sides, said shroud having a plurality of openings including said first-mentioned openings, said openings lying in said sides of said shroud near each end thereof.

said locking devices each have a pair of said inner parts lying facewise substantially against said opposite sides of said first connector and pivotally connected thereto, and each device inner part and the facewise adjacent part of said first connector constructed so one part forms at least one projection and the other forms at least one recess that receives the projection at both said locked and unlocked positions of each device.

4. In a connector system which includes first and second connectors each having opposite ends, opposite sides, and inner and outer regions, and which have matable contacts at their inner regions, said second connector having a shroud that lies around its matable region, the improvement of a locking/separation mechanism comprising:

first and second locking members, each lying at a different one of said ends of said first connector, each member including a pair of parallel but spaced plate-like inner parts, and a bridging part connecting said inner part and forming a handle, said inner parts projecting from opposite sides of the widest portion of said first connector and each inner part pivotally connected to a different side of the first connector to enable pivoting about a pivot axis between locked and unlocked positions, each inner part having a latch;

said shroud has a pair of openings in substantially its entire thickness at its opposite sides, near its opposite ends, that receive said pair of inner parts of a locking member when said connectors are substantially mated both in said locked and unlocked positions of said inner parts of said locking members, and has a pair of undercut slots communicating with said openings and located to receive said latches when said locking members are in said locked positions, said locking member inner parts each having a thickness no more than about 50% greater than said shroud opposite sides.

5. The improvement described in claim 4 wherein:

said second connector has a base from which said contacts of said second connector projects, said shroud extends outwardly from said base, and said openings each extend from the outer edge of said shroud substantially to said base;

said inner parts of each locking member each has an eject part that presses substantially against said base as the locking member pivots from said locked position toward said unlocked position.

* * * * *